US010948154B1

(12) United States Patent
Yang

(10) Patent No.: US 10,948,154 B1
(45) Date of Patent: Mar. 16, 2021

(54) MODULAR LED LIGHT ASSEMBLY

(71) Applicant: Nathan Yang, Surrey (CA)

(72) Inventor: Nathan Yang, Surrey (CA)

( * ) Notice: Subject to any disclaimer, the term of this patent is extended or adjusted under 35 U.S.C. 154(b) by 0 days.

(21) Appl. No.: 16/814,757

(22) Filed: Mar. 10, 2020

(51) Int. Cl.

| | |
|---|---|
| ***F21V 1/02*** | (2006.01) |
| ***F21V 1/14*** | (2006.01) |
| ***F21V 23/06*** | (2006.01) |
| ***F21K 9/60*** | (2016.01) |

(52) U.S. Cl.
CPC ..... *F21V 1/02* (2013.01); *F21K 9/60* (2016.08); *F21V 1/14* (2013.01); *F21V 23/06* (2013.01)

(58) Field of Classification Search
None
See application file for complete search history.

(56) References Cited

U.S. PATENT DOCUMENTS

2006/0262545 A1* 11/2006 Piepgras ..... F21V 29/773 362/373
2013/0188353 A1* 7/2013 Nankil ..... F21K 9/65 362/235

* cited by examiner

*Primary Examiner* — Ashok Patel
(74) *Attorney, Agent, or Firm* — Gulf Coast Intellectual Property Group

(57) ABSTRACT

A LED light assembly configurable in a plurality of manners to offer various ornamental appearances. The LED light assembly of the present invention includes at least one core mounting member wherein the core mounting member further includes an inner engagement section formed proximate the upper opening thereof. The inner engagement section includes a wall and a bottom formed to mateably receive a shade member. A plurality of connection members are secured above the inner engagement section and are aligned so as to facilitate an electrical connection between pins of a LED light integrally formed with a shade member that is operably coupled to the core mounting member. The present invention further includes a plurality of connection members that are operably coupled to the core mounting member so as to assemble a plurality of core mounting members to create a desired ornamental appearance of the LED light assembly.

9 Claims, 2 Drawing Sheets

MODULAR LED LIGHT ASSEMBLY

FIELD OF THE INVENTION

The present invention relates generally to lighting assemblies, more specifically but not by way of limitation, a LED light assembly having a modular shade wherein a light emitting diode is in the center of the shade and wherein the light assembly of the present invention is configurable in numerous physical presentations utilizing a core mount member.

BACKGROUND

LED lights and lighting apparatus are known in the art. Over the last decade numerous designs and applications for LED lights have been introduced as the market demand has increased. LED lights are typically low voltage lights but can also be powered by conventional alternating current voltage. There are a plurality of power connection configurations for existing LED light assemblies that include configuration such as direct power or pin contact with printed circuit boards.

The aforementioned pin contact with printed circuit boards are employed for various LED light applications. One problem with existing configurations is the LED light must be installed properly in order to ensure the pins do not engage the power strip having opposite polarity. Many conventional assemblies are labeled to provide warning of the correct installation but do not provide any additional assistance. Furthermore, most conventional LED assemblies are fixed in their layout and not configurable. By way of example but not limitation, there are no LED lamp style light assemblies that provide a user a technique or alternate method of changing the configuration of the light assembly.

It is intended within the scope of the present invention to provide a led light assembly that is modular in manner wherein there are various configurations available for the light assembly and furthermore provides a structure that facilitates operable connection with the LED light and the power source wherein the connection ensures a proper polarity connection.

SUMMARY OF THE INVENTION

It is the object of the present invention to provide a modular led light assembly that includes a core mounting member wherein in the preferred embodiment the core mounting member is annular in shape.

Another object of the present invention is to provide a led lighting assembly that is configurable in various physical presentations wherein the present invention includes a releasably secured shade member.

A further object of the present invention is to provide a modular led light assembly that includes a core mounting member wherein the shade member incorporates a led light in the center thereof.

Still another object of the present invention is to provide a led lighting assembly that is configurable in various physical presentations wherein the core mounting member includes a plurality of mounting slots.

An additional object of the present invention is to provide a modular led light assembly wherein the mounting slots are axially aligned with a metal core printed circuit board on the perimeter of the core mounting member.

Yet a further object of the present invention is to provide a led lighting assembly wherein the metal core printed circuit board is configured with electrical connections that align to mating pins on the led light.

Another object of the present invention is to provide a modular led light assembly wherein the mounting slots are configured to ensure alignment between the metal core printed circuit board and the led light contact pins.

An alternate object of the present invention is to provide a led lighting assembly wherein the present invention is a low voltage light assembly so as to permit installation of the lighted shade when the power is cycled on.

Still a further object of the present invention is to provide a modular led light assembly wherein the core mounting member and the mounting slots facilitate a twist mount for securing the led lamp shade member.

A further object of the present invention is to provide a led lighting assembly wherein the assembly of the present invention can be configured to include a single core mounting member or a plurality of core mounting members.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
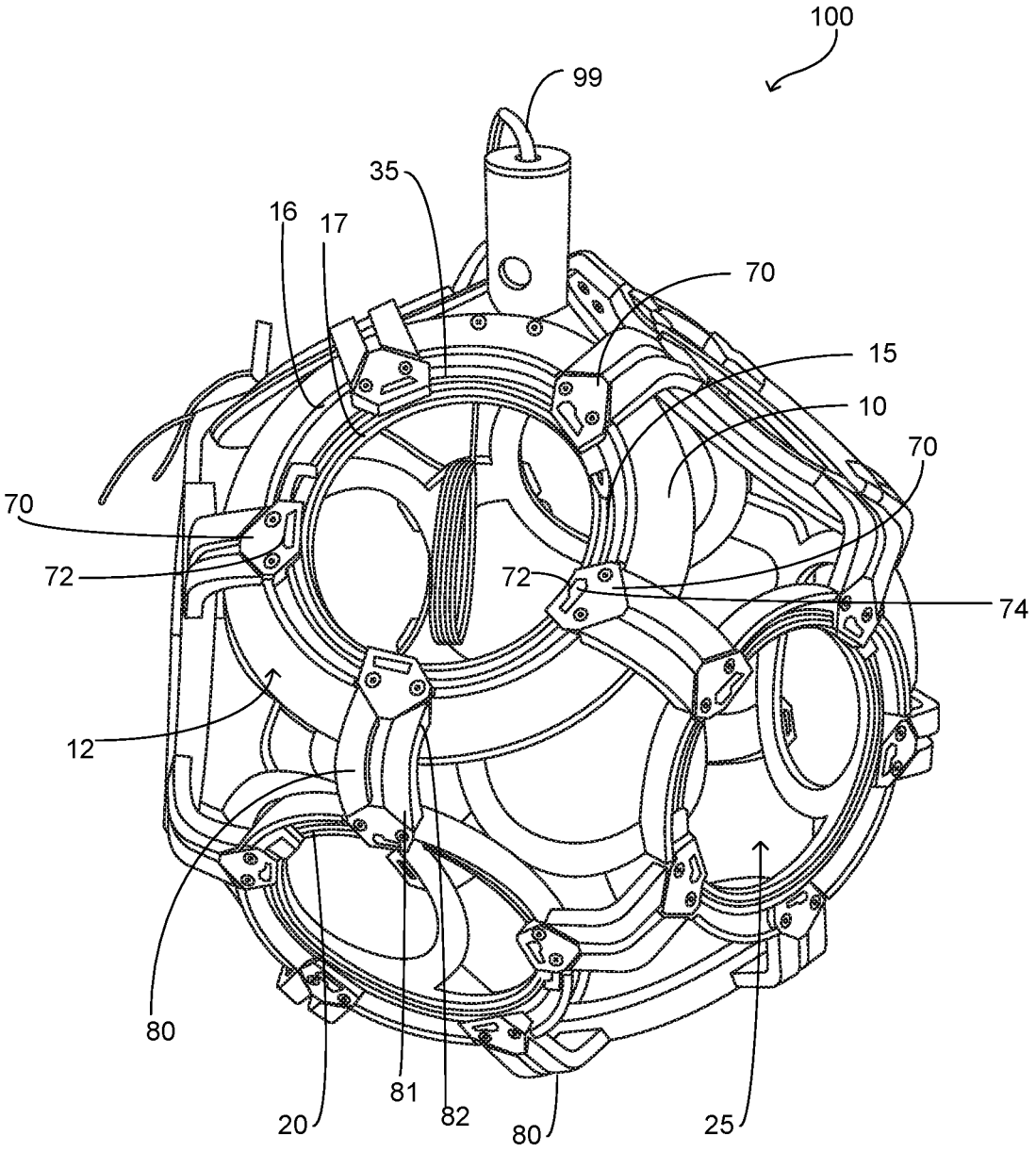
FIG. 1 is a perspective view of an exemplary embodiment of a configuration of core mounting members of the present invention.

References now to the drawings submitted herewith, wherein various elements depicted therein are not necessarily drawn to scale and wherein through the views and figures like elements are referenced with identical reference numerals, there is illustrated a LED light assembly 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring to the Figures submitted herewith, the LED light assembly 100 includes a core mounting member 10. The core mounting member 10 is planar in form and is manufactured from a suitable rigid material such as but not limited to metal. While the core mounting member 10 is annular in shape in the drawings submitted as a part hereof, it should be understood within the scope of the present invention that the core mounting member 10 can be provided in various alternate shapes such as but not limited to linear and other geometric shapes. The core mounting member 10 include an inner engagement section 15. The inner engagement section 15 is contiguous around the inner edge 20 wherein the inner edge 20 defines the shape of the opening 25 formed centrally in the core mounting member 10. The inner engagement section 15 is integrally formed with the body 12 of the core mounting member 10 utilizing suitable techniques. The inner engagement section 15 includes a wall member 16 and a bottom 17 that are perpendicularly formed so as to facilitate mateable engagement with the shade member 40.

The bottom 17 of the inner engagement section 15 has operably disposed thereon a printed circuit board 35. The printed circuit board 35 is formed in the shape of the inner engagement section 15 and in a preferred embodiment the printed circuit board is a metal core printed circuit board. The printed circuit board 35 is electrically coupled to wire 99 wherein the wire is electrically coupled to a conventional power source. The printed circuit board 35 is configured to have imprinted thereon the necessary elements so as to facilitate an electrical connection with the led light 50 that is integrally secured to the shade member 40.

Operably coupled to the core mounting member 10 are a plurality of connection members 70. The connection members 70 are secured to the core mounting member 10 utilizing suitable techniques and are superposed the inner engagement section 15. The connection members 70 are manufactured from a durable rigid material such as but not limited to metal. The connection members 70 include a slot 72 formed therein. The slot 72 is oblong in form having an opening 74. The slot 72 and the opening 74 thereof are configured to provide simplified coupling of the shade member 40 and the core mounting member 10. The connection member 70 and the slot 72 formed therein provide alignment so as to ensure electrical contact mating pins (not illustrated herein) of the led light 50 electrically couple with the printed circuit board 15. The connection members 70 further ensure a simplified operable coupling with the shade member 40 wherein a preferred technique to operably couple the shade member 40 and the connection members 70 is a engage and twist method wherein structures on the shade member 40 engage the inner engagement member 15 and/or the connection member to provide a coupling thereof requiring no tools.

The LED light assembly 100 in a preferred embodiment includes structural support members 80. The structural support members 80 are configured to provide coupling of a plurality of core mounting members 10 so as to create a desired structural appearance of the LED light assembly 100. The structural support members 80 are manufactured from a durable rigid material such as but not limited to metal. The structural support members 80 for the embodiment illustrated herein in FIG. 1 are arcuate in shape so as to assist in the assembly of the overall ornamental configuration that is illustrated in FIG. 1. It should be understood within the scope of the present invention that the structural support members 80 could be formed in alternate shapes and sizes in order to facilitate assembly of the LED light assembly 100 into a desired ornamental appearance. By way of example but not limitation, the led light assembly 100 could be arranged in a linear pattern or further be secured in a planar manner on a wall surface. The structural support members 80 include a first end 81 and second end 82. The first end 81 and second end 82 are mechanically coupled to the core mounting member 10 utilizing suitable durable techniques.

Figure 2:
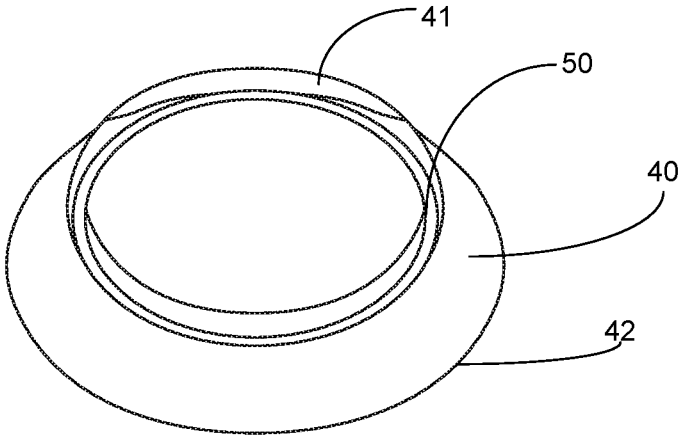
FIG. 2 is a perspective view of a led lamp shade of the present invention.
Figure 3:
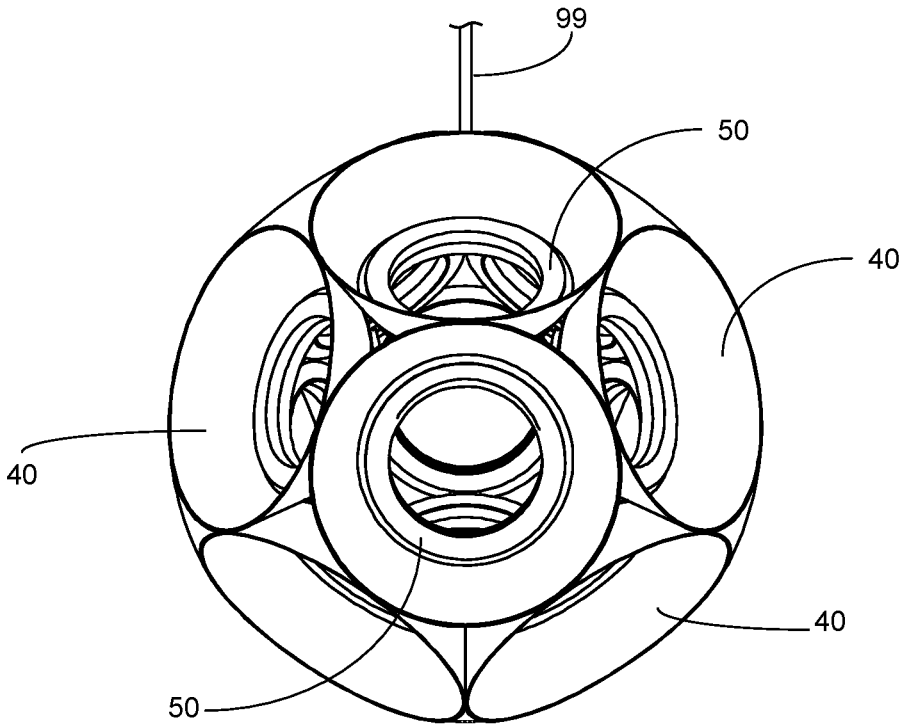
FIG. 3 is a perspective view of an exemplary configuration of the light assembly of the present invention.

Illustrated herein in FIG. 2 is the shade member 40. The shade member 40 is manufactured from a rigid material such as but not limited to plastic and as conical in shape having an upper edge 41 and lower edge 42. The shade member 40 has secured therein a led light 50 wherein the led light 50 is proximate the upper edge 41. As previously discussed herein, the led light 50 is structured with contact pins (not illustrated herein) so as to facilitate the electrical coupling between the led light 50 and the printed circuit board 35. While an ornamental embodiment of a plurality of shade members 40 is illustrated herein, it should be understood within the scope of the present invention that the LED light assembly 100 could be comprised of only one core mounting member 10 and one shade member 40 or a plurality thereof. Furthermore, it should be understood within the scope of the present invention that the shade member 40 could be provided in numerous alternate shapes/styles and further be manufactured from alternate materials.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A led light assembly that is configured to be provided in a plurality of ornamental appearances wherein the led light assembly comprises:

at least one core mounting member, said at least one core mounting member having a body that is planar in manner, said at least one core mounting member having an opening centrally located in said body, said at least one core mounting member having an inner engagement section, said inner engagement section being proximate said opening;

a shade member, said shade member having an inner surface and an outer surface;

a light, said light being secured to said shade member, said light being secured to said inner surface of said shade member proximate said upper end of said shade member.

2. The led light assembly as recited in claim 1, wherein the inner engagement section further includes a wall and a bottom, said wall and said bottom being perpendicular in configuration.

3. The led light assembly as recited in claim 2, wherein said bottom further includes a printed circuit board on a surface thereof.

4. The led light assembly as recited in claim 3, and further including a plurality of connection members, said plurality of connection members being proximate said inner engagement section, said plurality of connection members configured to facilitate an operable coupling of the shade member and the core mounting member.

5. The led light assembly as recited in claim 4, wherein the plurality of connection members include a slot, said slot being axially aligned with said bottom of said inner engagement section.

6. A led light assembly that is configurable in various ornamental presentations wherein the led light assembly comprises:

a plurality of core mounting members, said at plurality of core mounting members having a body that is planar in manner and annular in shape, said plurality of core mounting members having an opening centrally located in said body, said plurality of core mounting members having an inner engagement section, said inner engagement section being proximate said opening, said inner engagement section having a wall and a bottom being contiguously formed, said bottom having a printed circuit board superposed thereon, said printed circuit board being coupled to a power supply;

a plurality of shade members, said plurality of shade members being manufactured from a rigid material, said plurality of shade members having an inner surface and an outer surface, said plurality of shade member being conical in shape;

a light, said light being secured to said shade member, said light being secured to said inner surface of said plurality of shade members proximate said upper end of said shade member; and a plurality of connection members, said plurality of connection members being proximate said inner engagement section, said plurality of connection members configured to facilitate an operable coupling of the shade member and the core mounting member.

7. The led light assembly as recited in claim 6, wherein the plurality of connection members include a slot, said slot being axially aligned with said bottom of said inner engagement section, said slot operable to facilitate coupling of the plurality of shade members to the plurality of core mounting members.

8. The led light assembly as recited in claim 7, and further including a plurality of structural support members, said structural support members configured to operably coupled said plurality of core mounting members.

9. The led light assembly as recited in claim 8, wherein said slot of said plurality of connection members are oblong in shape.

* * * * *